United States Patent [19]

Daikohara

[11] Patent Number: 4,701,109

[45] Date of Patent: Oct. 20, 1987

[54] COMPRESSOR WITH ROTATION DETECTING DEVICE

[75] Inventor: Tamotsu Daikohara, Shin, Japan

[73] Assignee: Sanden Corporation, Gunma, Japan

[21] Appl. No.: 850,554

[22] Filed: Apr. 11, 1986

[30] Foreign Application Priority Data

Apr. 11, 1985 [JP] Japan ..... 60-52733[U]

[51] Int. Cl.[4] ..... F04B 49/00; F04B 1/14

[52] U.S. Cl. ..... 417/223; 417/269

[58] Field of Search ..... 417/223, 319, 269, 270; 92/71

[56] References Cited

U.S. PATENT DOCUMENTS

| | | | |
|---|---|---|---|
| 4,355,959 | 10/1982 | Kono et al. | 417/223 |
| 4,393,966 | 7/1983 | Kono et al. | 417/223 |
| 4,462,491 | 7/1984 | Kono et al. | 417/319 |
| 4,480,961 | 11/1984 | Kono et al. | 417/223 |
| 4,594,055 | 6/1986 | Hideharu et al. | 417/269 |

FOREIGN PATENT DOCUMENTS

| | | | |
|---|---|---|---|
| 54-312 | 4/1979 | Japan | 417/269 |
| 96377 | 7/1980 | Japan | 417/269 |

*Primary Examiner*—W. L. Freeh

*Attorney, Agent, or Firm*—Banner, Birch, McKie & Beckett

[57] ABSTRACT

A rotation detecting device for a wobble plate type compressor comprises a rear thrust race (23) disposed on the rear surface of the wobble plate (8) and moveable therewith. The rear thrust race has two nail portions (231, 232) and a projecting portion (233). A magnetic pickup (24) is mounted on the cylindrical housing (2) of the compressor and is positioned thereon opposite a locus of movement of projecting portion (233). Magnetic flux leaking from an electromagnetic clutch mounted on the compressor flows to rear thrust race (23) through a drive shaft (17) and bevel gear (14). When projecting portion (233) passes opposite magnetic pickup (24), a magnetic flux is produced. Magnetic pickup (24) detects the magnetic flux and thus detects movement of wobble plate (8). Thus the connection between the compressor and the driving source can be quickly interrupted in the event of compressor malfunction.

1 Claim, 4 Drawing Figures

COMPRESSOR WITH ROTATION DETECTING DEVICE

TECHNICAL FIELD

The invention relates to a compressor for an automobile air conditioner including a rotation detecting device.

BACKGROUND OF THE INVENTION

In an automotive air conditioning compressor, when the rotation of the compressor is stopped by locking of a rotating member, the connection between a driving source and the compressor should be quickly disengaged to prevent damage to the driving parts of the automobile. Such disengagement is particularly desirable where the compressor and other auxillary equipment, e.g., an alternator, power steering, are coupled to the engine output through a single power transmission belt to ensure that operation of the other equipment remains unaffected by the compressor malfunction.

Various rotation detecting devices have been proposed which detect compressor locks by sensing changes in the rotational speed of the compressor and interrupting the driving force to the compressor when the rotational rate falls below a predetermined reference rate. One such rotation detecting device comprises a magnetic flux changing portion, which varies the magnetic flux density formed by a magnetic pickup in accordance with the rotation of a drive shaft, and a magnetic detecting device, which detects the change in flux density. The construction of those prior art devices is, however, very complicated, and may also be difficult to complete. Further, such devices suffer from reliability problems. For example, if a magnet is used as the flux changing portion which has a relatively large magnetic flux, it may absorb iron grains from the interior of the compressor, resulting in unreliable results. The reliability of the device may also be adversely affected by temperature changes in the interior of the compressor as some magnets are temperature sensitive and will lose their magnetic properties if the temperature increases above, or decreases below, a certain level.

SUMMARY OF THE INVENTION

It is an object of the present invention to provide an air conditioner compressor with a rotation detecting device which has high reliability.

It is another object of the present invention to provide an air conditioner compressor with a rotation detecting device which is simple in construction.

The present invention is directed to an automobile air conditioner compressor. The compressor includes a housing, a drive shaft rotatably supported in the housing, and an electromagnetic clutch mounted on the compressor housing for selectively coupling the drive shaft to an external driving source. A cam rotor which is inclined on one end surface is drivingly coupled to the drive shaft. A wobble plate is disposed adjacent the inclined surface of the rotor and nutates corresponding to the movement of the cam rotor. The rotation detecting device comprises a rear thrust race which has a projecting portion and is disposed on the inclined surface of the wobble plate and moveable therewith. The detecting device receives the magnetic flux which leaks from the electromagnetic clutch through the drive shaft. A magnetic pickup is disposed on the housing and is located opposite a portion of the movement locus of the projecting portion of the rear thrust race to sense variations in the magnetic flux density as the projecting portion passes opposite the magnetic pickup.

Further objects, features and other aspects of the present invention will be understood from the following detailed description of the preferred embodiments of the present invention referring to the attached drawings.

DETAILED DESCRIPTION OF THE PREFERRED EMBODIMENTS

Figure 1:
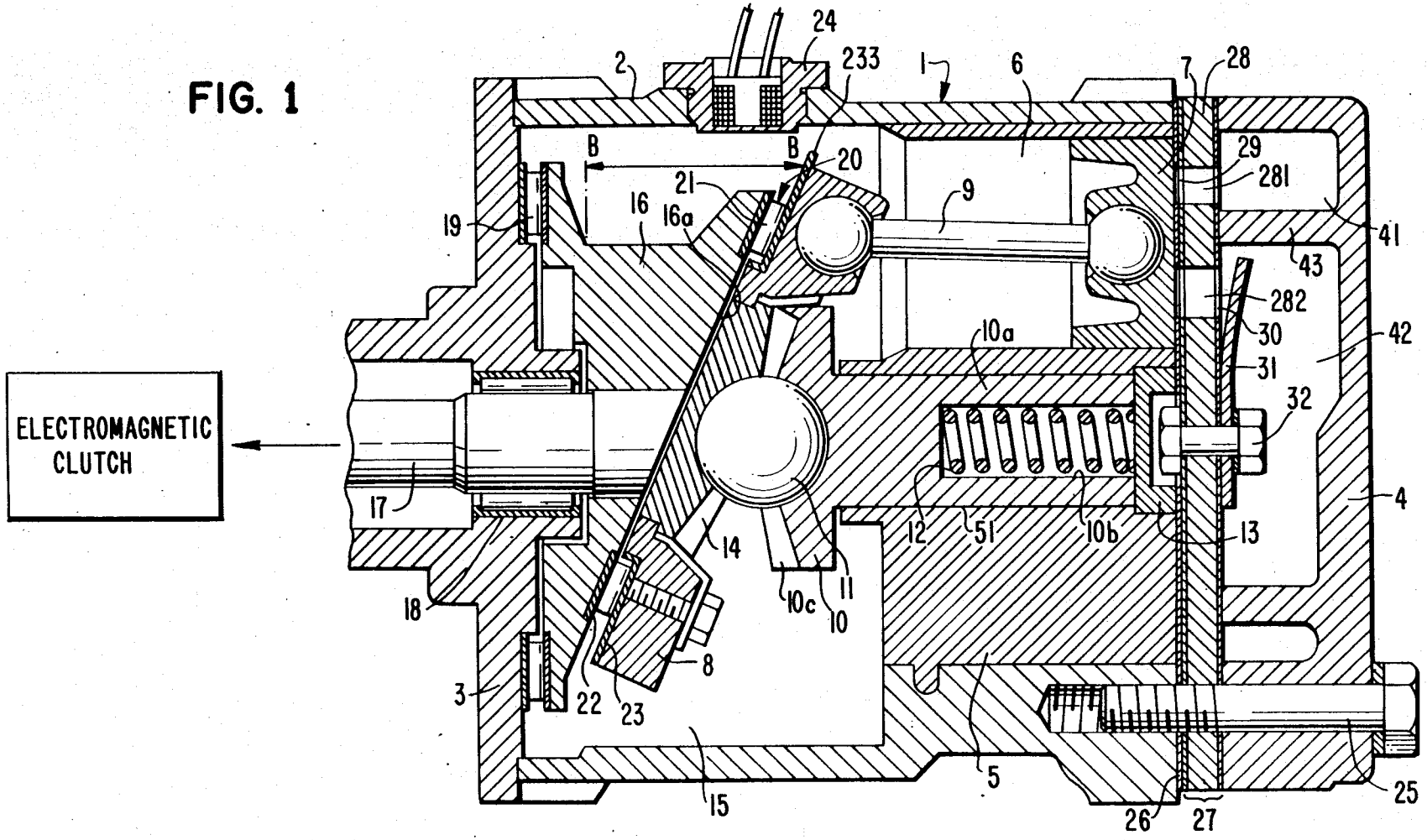
FIG. 1 is a sectional view of a wobble plate type compressor with a rotation detecting device constructed in accordance with the present invention.

Referring to FIG. 1, a wobble plate type compressor with a rotation detecting device is shown. Compressor 1 comprises cylindrical casing 2, front housing 3 and cylinder head 4. Front housing 3 is secured to one end of cylindrical casing 2. The interior of cylindrical casing 2 defines crank chamber 15 between cylinder block 5 and front housing 3. Cam rotor 16 is disposed within crank chamber 15 and is fixedly mounted to the inner end of drive shaft 17. Drive shaft 17 extends through a central portion of front housing 3 and is rotatably supported by needle bearing 18 in front housing 3. Cam rotor 16 is inclined on one end surface and is supported on the inner surface of front housing 3 by thrust needle bearing 19. Wobble plate 8 is disposed in close proximity with the inclined surface **16*a* of cam rotor 16 and is supported by thrust needle bearing 20 which comprises ball 21 and rear thrust race 22 and 23**.

Figure 2:
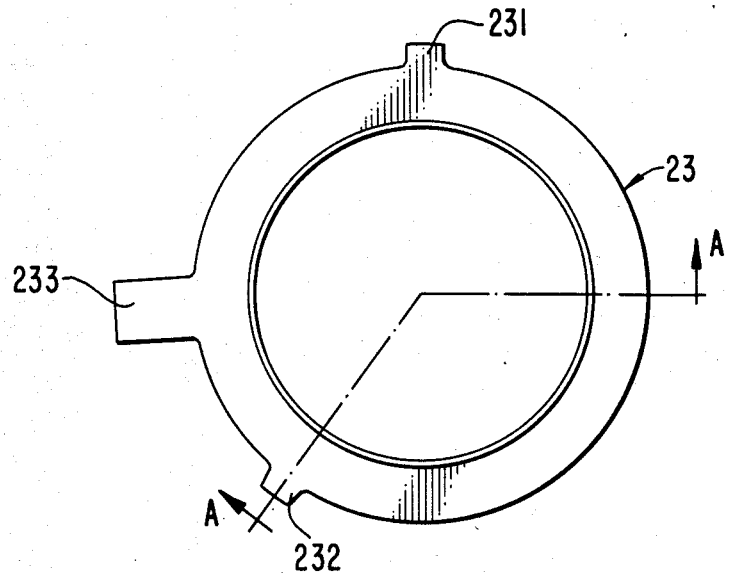
FIG. 2 is a plan view of a rear thrust race which is shown in FIG. 1.
Figure 3:
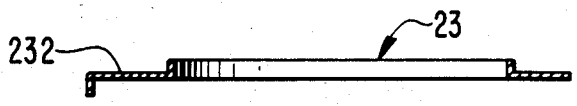
FIG. 3 is a sectional view taken along line A—A of the rear thrust race shown in FIG. 2.

Referring to FIGS. 2 and 3, there is shown rear thrust race 23 which has nail portions 231 and 232 and projecting portion 233. Nail portions 231 and 232 are L-shaped in section and projecting portion 233 is flat.

Figure 4:
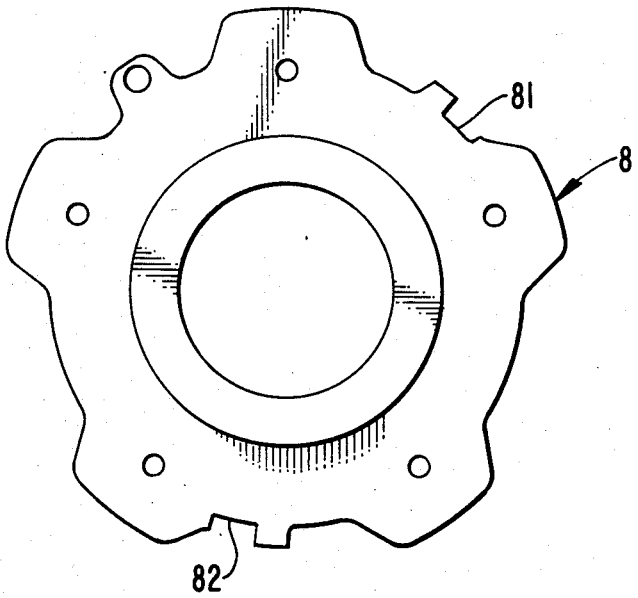
FIG. 4 is a rear view of the wobble plate which is shown in FIG. 1.

Referring to FIG. 4, there is shown a rear view of wobble plate 8 on which rear thrust race 23 is mounted. Each of nail portions 231 and 232 is fitted into each of receiving portions 81 and 82 so that rear thrust race 23 is prevented from rotating and the position of projecting portion 233 is radially fixed.

Referring again to FIG. 1, magnetic pickup 24 is disposed on cylindrical casing 2 and is located opposite a portion of the movement locus of projecting portion 233 during operation of wobble plate 8. Magnetic flux which flows from an elecltromagnetic clutch (not shown) is communicated to projecting portion 233 of rear thrust race 23 through drive shaft 17 and bevel gear 14. The magnetic flux which is communicated to bevel gear 14 leaks to thrust needle bearing 20. Thus, projecting portion 233 of rear thrust race 23 is magnetized whenever the electromagnetic clutch is turned on.

Cylinder block 5 is closely fitted into and secured to cylindrical casing 2. Cylinders 6 are disposed on the circumference of the center axial line of cylindrical casing 2 in cylinder block 5 at equiangular intervals. Pistons 7 are slidably and closely fitted within cylinders 6. Each piston 7 is coupled to wobble plate 8 through piston rod 9. The connection between piston rod 9 and piston 7 and the connection between piston rod 9 and wobble plate 8 are achieved through ball joint mechanisms.

Supporting member 10 comprises shank portion 10*a* having axial hole 10*b* at one end thereof and bevel gear portion 10*c* at the other end of shank portion 10*a*. Gear portion 10*c* has a seat for steel ball 11 at the center thereof. Supporting member 10 is axially slidably, but non-rotatably, supported within cylinder block 5 by inserting shank portion 10*a* into a central axial hole 51. The rotation of supporting member 10 is prevented by key and key groove members (not shown). Coil spring 12 is disposed in axial hole 10*b* of supporting member 10. The outer end of spring 12 is in contact with screw member 13 screwed into central hole 51 of cylinder block 5, so that supporting member 10 is urged toward wobble plate 8 through steel ball 11.

Bevel gear portion 10*c* of supporting member 10 engages with bevel gear 14 mounted on wobble plate 8 so that wobble plate 8 is prevented from rotating. Steel ball 11 is seated in the seat formed at the central portion of bevel gear portion 10*c* and is also seated in a seat formed at the central portion of bevel gear 14, so that wobble plate 8 is nutatably, but non-rotatably, supportd on steel ball 11.

Cylinder head 4 is disposed on the outer end of cylinder block 5 and is secured thereto by bolts 25, with gasket member 26 and valve plate assembly 27 being interposed between cylinder head 4 and cylinder block 5.

Cylinder head 4 includes a suction chamber 41 and a discharge chamber 42 formed on the interior side thereof and defined by annular partition wall 43. Valve plate assembly 27 comprises a valve plate 28 having suction ports 281 connecting suction chamber 41 and respective cylinders 6, and discharge ports 282 connecting discharge chamber 42 and respective cylinders 6. Valve plate assembly 27 also comprises suction reed valve member 29, discharge reed valve member 30, stopper plate 31 for suppressing excessive deformation of discharge reed valve 30, and bolt and nut means 32 for securing the suction and discharge reed valves and the stopper member to the valve plate.

In operation of the compressor, drive shaft 17 is driven by any suitable driving means, such as automobile engine. Cam rotor 16 rotates with drive shaft 17, so that wobble plate 8 nutates about steel ball 11. The nutation of wobble plate 8 causes reciprocating movement of respective pistons 7 within cylinders 6 which results in compression and discharge of the refrigerant gas. The nutation of wobble plate 8 also causes reciprocating movement of projecting portion 233 of rear thrust race 23, so that projecting portion 233 moves forward or backward past magnetic pickup 24, along the arrow B—B. Magnetic pickup 24 detects the magnetic flux density at successive passes of projecting portion 233 and thus senses movement of the wobble plate. As a result, the connection between the driving source and the compressor can be quickly interrupted in the event of a compressor lock.

Although the invention has been described in detail in connection with the preferred embodiments thereto, it will be easily understood, by those skilled in the art, that other variations and modifications can be easily made within the scope of the invention as defined by the appended claims.

I claim:

1. A rotation detecting device for a refrigerating compressor including a housing, a drive shaft rotatably supported in said housing, an electromagnetic clutch mounted on said compressor housing for selectively coupling said drive shaft to an external driving source, a cam rotor drivingly coupled to said drive shaft, a wobble plate disposed proximate the surface of the rotor and means for preventing rotation of said wobble plate so that the wobble plate nutates during movement of said cam rotor, comprising:

a rear thrust race disposed on the surface of said wobble plate and receiving the magnetic flux leaking from said electromagnetic clutch, said rear thrust race having a projecting portion; and a magnetic pickup disposed on said housing and located thereon opposite a locus of movement of said projecting portion, said magnetic pickup detecting the magnetic flux density at successive passes of the projecting portion during movement of the wobble plate.

* * * * *